US005189921A

United States Patent [19]

Nagashima et al.

[11] Patent Number: 5,189,921

[45] Date of Patent: Mar. 2, 1993

[54] STARTER SYSTEM FOR AN INTERNAL COMBUSTION ENGINE

[75] Inventors: Shinichi Nagashima; Hitoshi Ono, both of Tochigi; Kazuhiro Yamamoto, Gumma, all of Japan

[73] Assignee: Mitsuba Electric Mfg. Co., Ltd., Japan

[21] Appl. No.: 703,961

[22] Filed: May 22, 1991

[30] Foreign Application Priority Data

Jun. 5, 1990 [JP] Japan ..... 2-146924

[51] Int. Cl.[5] ..... F02N 15/06

[52] U.S. Cl. ..... 74/7 A; 74/7 E

[58] Field of Search ..... 74/6, 7 A, 7 C, 7 E; 475/331

[56] References Cited

U.S. PATENT DOCUMENTS

| | | | |
|---|---|---|---|
| 3,972,106 | 8/1976 | Orr | 475/331 X |
| 4,519,261 | 5/1985 | Hamano | 475/331 X |
| 4,635,489 | 1/1987 | Inamura et al. | 74/7 A X |
| 4,891,996 | 1/1990 | Isozumi et al. | 74/6 |
| 4,899,605 | 2/1990 | Tanaka | 475/331 X |
| 4,951,515 | 8/1990 | Morishita et al. | 74/7 E |
| 5,086,658 | 2/1992 | Isozumi | 74/7 E |

FOREIGN PATENT DOCUMENTS

| | | | |
|---|---|---|---|
| 58-53857 | 4/1983 | Japan . | |
| 3-20141 | 1/1991 | Japan | 475/331 |

*Primary Examiner*—Allan D. Herrmann
*Attorney, Agent, or Firm*—Skjerven, Morrill, MacPherson, Franklin & Friel

[57] ABSTRACT

In a starter system for an internal combustion engine using a planetary reduction gear unit, the internal gear of the planetary reduction gear unit, the center bracket accommodating the internal gear and the pinion cover are joined together so as not to rotate relative to one another by using radial projections provided in the outer circumferential surface of the internal gear which are passed through openings provided in the center bracket and received by associated recesses provided in the pinion cover. The three members are thus prevented from rotating relative to one another with a simple structure which is also easy to assemble. The projection of the internal gear may also be used for securing an annular seal member interposed between an axial end surface of the internal gear and the corresponding shoulder surface of the center bracket.

6 Claims, 2 Drawing Sheets

STARTER SYSTEM FOR AN INTERNAL COMBUSTION ENGINE

TECHNICAL FIELD

The present invention relates to a starter system for an internal combustion engine, and in particular to an improved engine starter system using a planetary reduction gear unit.

BACKGROUND OF THE INVENTION

Conventionally, various starters for cranking an internal combustion engine have been known. Typically, in such a starter, as disclosed in Japanese patent laid open publication No. 58-53857, U.S. Pat. Nos. 4,604,907, 4,561,316, 4,573,364, 4,520,285, 4,510,406, and 4,528,470, a planetary gear reduction unit is provided between a DC motor and a pinion to transmit the driving force of the DC motor to the pinion for driving a ring gear of the engine.

In an engine starter system having such a structure, it is necessary to prevent the rotation of the internal gear of the planetary reduction gear unit relative to its center bracket, and to mount the center bracket on the casing so as not to rotate relative to the casing. According to the conventional structure, the internal gear is prevented from rotating relative to the casing by providing engagement projection and recess structures between the internal gear and the center bracket as well as between the center bracket and the casing. However, the need for the two engagement projection and recess structures complicates not only the structure of the center bracket but also the overall structure.

BRIEF SUMMARY OF THE INVENTION

In view of such problems of the prior art, a primary object of the present invention is to provide a starter system for an internal combustion engine which can simplify the structure for preventing the internal gear of a planetary reduction gear unit and its center bracket from rotating relative to the casing.

A second object of the present invention is to provide an engine starter system which allows its drive train to be assembled in an efficient manner.

These and other objects of the present invention can be accomplished by providing a starter system for an internal combustion engine, comprising: an electric motor accommodated in a motor casing; a center bracket coaxially attached to an end portion of the motor casing defining a cylindrical chamber for accommodating a planetary reduction gear unit therein between the center bracket and an end plate of the motor casing; and a pinion cover secured to a same longitudinal end of the electric motor as the center bracket defining a chamber for accommodating an overrunning clutch having an input member connected to an output end of the planetary reduction gear unit and an output member carrying a pinion thereon; one of an internal gear of the planetary reduction gear unit and the pinion cover being provided with a projection which passes through an opening provided in the center bracket and engages with a recess provided in the other of the internal gear of the planetary reduction gear unit and the pinion cover.

The three members are thus prevented from rotating relative to one another with a simple structure which is also easy to assemble.

According to a preferred embodiment of the present invention, the projection consists of a radial projection extending radially from an outer circumferential surface of the internal gear, and the recess consists of a recess provided in an annular shoulder defined in an inner circumferential surface of an open end of the pinion cover facing the center bracket. Further, the center bracket may be provided with a cylindrical portion adapted to receive an outer circumferential surface of the internal gear, and a radial flange extending outwardly from a longitudinal end of the cylindrical portion facing the electric motor, the opening being defined over an outer wall of the cylindrical portion and the radial flange of the center bracket.

If the motor case end plate is provided with a longitudinal projection which is adapted to be fitted into the opening provided in the center bracket, the motor end plate is also prevented from rotating by conveniently making use of the opening provided in the center bracket. Thus, the engagement structure for preventing mutual rotation can be achieved for a large number of component parts with a minimum amount of labor. Also, the comprehensive nature of the engagement structure for preventing mutual rotation also leads to the simplification of the assembly work.

For instance, the motor casing, the internal gear, the center bracket, and the pinion cover may be joined together by a pair of threaded bolts passed through the motor case and the pinion cover in a simple yet highly secure manner.

In particular, an annular seal member may be interposed between a shoulder surface of the center bracket adjoining a base end the cylindrical portion and a longitudinal end surface of the internal gear for the purpose of accommodating longitudinal dimensional errors related to the positions of the internal gear and the center bracket and preventing leakage of grease from the planetary gear unit to the electric motor. In this case, the seal member may be provided with a radial projection which is adapted to be received by the opening of the center bracket and provided with an opening for receiving the projection of the internal gear so that the seal member may be prevented from rotating relative to the center bracket, and the seal member may be conveniently attached to the internal gear in advance for assembly purpose.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
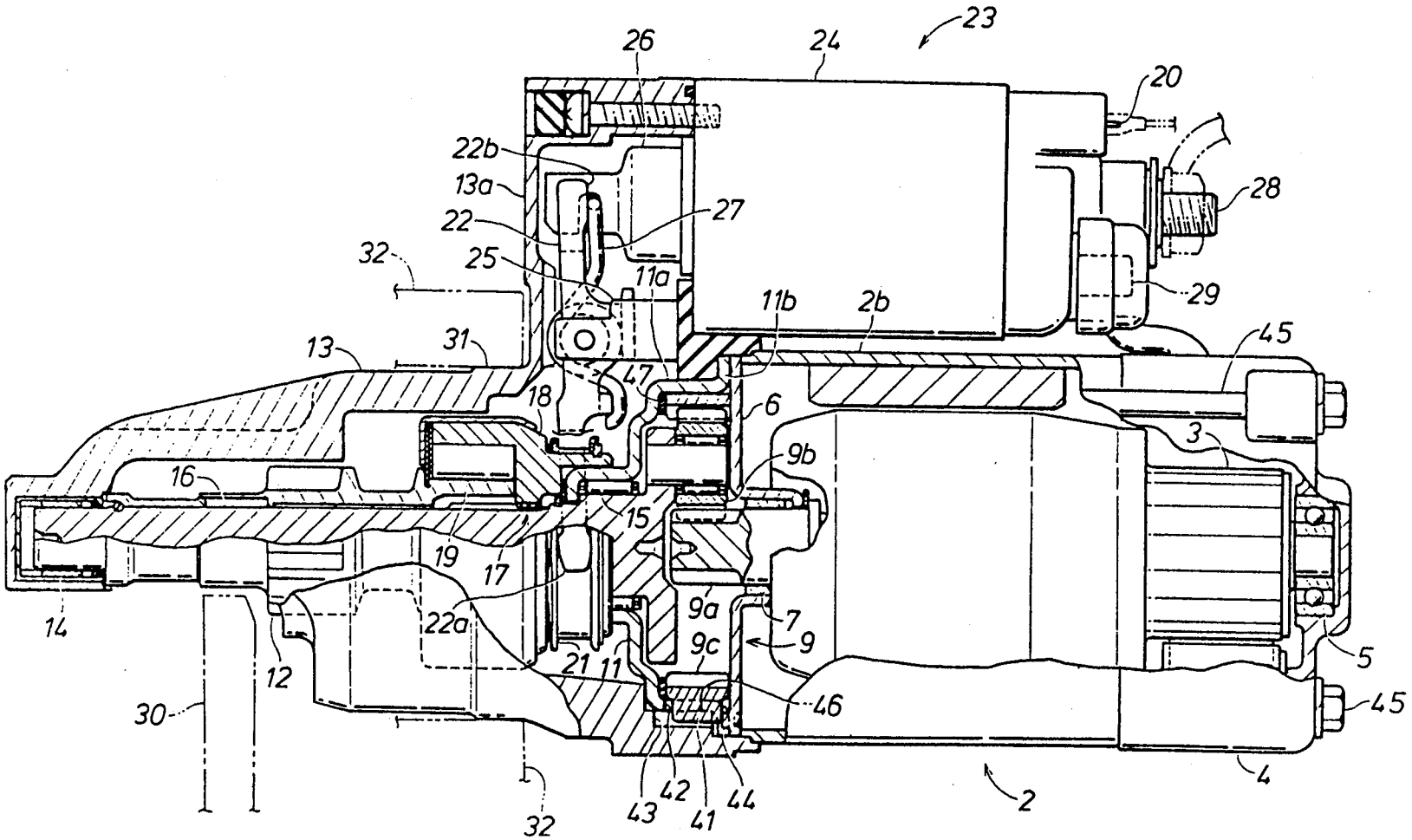
FIG. 1 is an overall longitudinal sectional view of a starter system for an internal combustion engine according to the present invention.

FIG. 1 generally shows a starter 1 equipped with a reduction gear unit given here as an embodiment of the starter system for an internal combustion engine according to the present invention, and this starter 1 powered by a DC motor 2 produces a rotational power for cranking an engine. As seen in the drawing, the right end of the motor shaft 2*a* of the DC motor 2 is rotatably supported by a ball bearing 5 secured to an end cover 4 covering a commutator 3, and the left end of the motor shaft 2a is supported by a metal bearing 7 secured to a separator 6 serving as an end plate of the motor 2.

To the left side of the motor shaft 2a as seen in the drawing is provided a planetary reduction gear unit 9 serving as a reduction gear system, and a sun gear 9a is mounted on the left free end of the motor shaft 2a. Planetary gears 9b mesh with the sun gear 9a. On the left end of the separator 6 is placed a center bracket 11 defined with a small and a large axial cylindrical portion. The large diameter cylindrical portion 11a of the center bracket 11 receives an internal gear 9c having internal teeth, and the planetary reduction gear unit 9 is received in the space defined between the separator 6 and the center bracket 11.

The separator 6 and the center bracket 11 are fixedly secured between a pinion cover 13 serving as a casing for receiving a pinion 12 which is described hereinafter and a casing 2b of the motor 2. The two ends of a drive shaft 16 are supported by a metal bearing 14 fixedly secured to the left free end of the pinion cover 13 as seen in the drawing and a roller bearing 15 fitted in the smaller cylindrical portion of the center bracket 11, coaxially with the motor shaft 2a. The planetary gears 9b are pivotally supported by a radial flange portion provided at the right end of the drive shaft 16 as seen in the drawing and received in the center bracket 11.

A spline coupling portion 17 consisting of a helical spline is provided between an outer circumferential surface of an intermediate part of the drive shaft 16 and an inner circumferential portion of an clutch outer member 18 of an overrunning clutch consisting of a one-way roller clutch, and an inner clutch member 19 thereof rotatably and axially slidably mounted on the drive shaft 16. The pinion 12 is integrally formed on a axial free end of the clutch inner member 19 on the left hand side of the drawing for driving a ring gear 30 of the engine.

The clutch outer member 18 is provided with an annular recess 21 around its circumference, and a bifurcated working end 22a of a shift lever 22 engages with this annular recess 21. The shift lever 22 is received in a radially extending peninsular portion 13a integrally formed with the pinion cover 13, and a middle part of the shift lever 22 is pivotally supported by a center bracket 25 interposed between a yoke 24 of an electromagnetic switch 23 connected to the peninsular portion 13a and the peninsular portion 13a itself. A plunger 26 of the electromagnetic switch 23 is engaged by a free end of a spring 27 which is supported by a center bracket 25 at an intermediate part thereof and engaged to a part of the shift lever 22 intermediate between the pivot shaft and the working end portion 22a. The free end 22b of the shift lever 22 remote from the working end 22a is also bifurcated, and is elastically engaged to the end of the spring 27 adjacent the plunger 26. Thus, the shift lever 22 can undergo a rotative motion according to the movements of the plunger 26 under the attractive force of the electromagnetic switch 23 when it is energized and the restoring force of the return spring in the electromagnetic switch 23 when the latter is not energized.

A battery connecting terminal 28 of the electromagnetic switch 23 is electrically connected to a battery not shown in the drawings, and a switch terminal 20 is electrically connected to an ignition switch not shown in the drawings while a motor connection terminal 29 is electrically connected to the motor 2. When the ignition switch is turned to the starter-on position, the electromagnetic switch 23 is energized, thereby causing the plunger 26 to be attracted thereto and the shift lever 22 to be rotated in clockwise direction in the sense of the drawing by way of the spring 27. As the working end 22a of the shift lever 22 pushes out the clutch outer member 18, at the same time, causing it to rotate by means of the spline coupling portion 17 provided in the drive shaft 16, the clutch inner member 19 or the pinion 12 comes into mesh with the ring gear 30 of the engine. The attracted movement of the plunger 26 causes an internal contact set to be closed and thereby the motor 2 to be rotated, and the rotation of the motor 2 is reduced in speed by the planetary reduction gear unit 9 and is transmitted to the pinion 12 which drives the ring gear 30 and cranks the engine.

Since, even when the plunger 26 has been activated but the pinion 12 has failed to mesh with the ring gear 30 by striking the end surface of the gear teeth of the ring gear 30, the plunger 26 can be completely attracted by the electromagnet on account of the deflection of the spring 27, the contact set of the electromagnetic switch 23 is closed in any case and the motor 2 is rotated so that the pinion 12 can continue to be rotated by the motor 2, and can eventually mesh with the ring gear 30 in a reliable manner.

Figure 2:
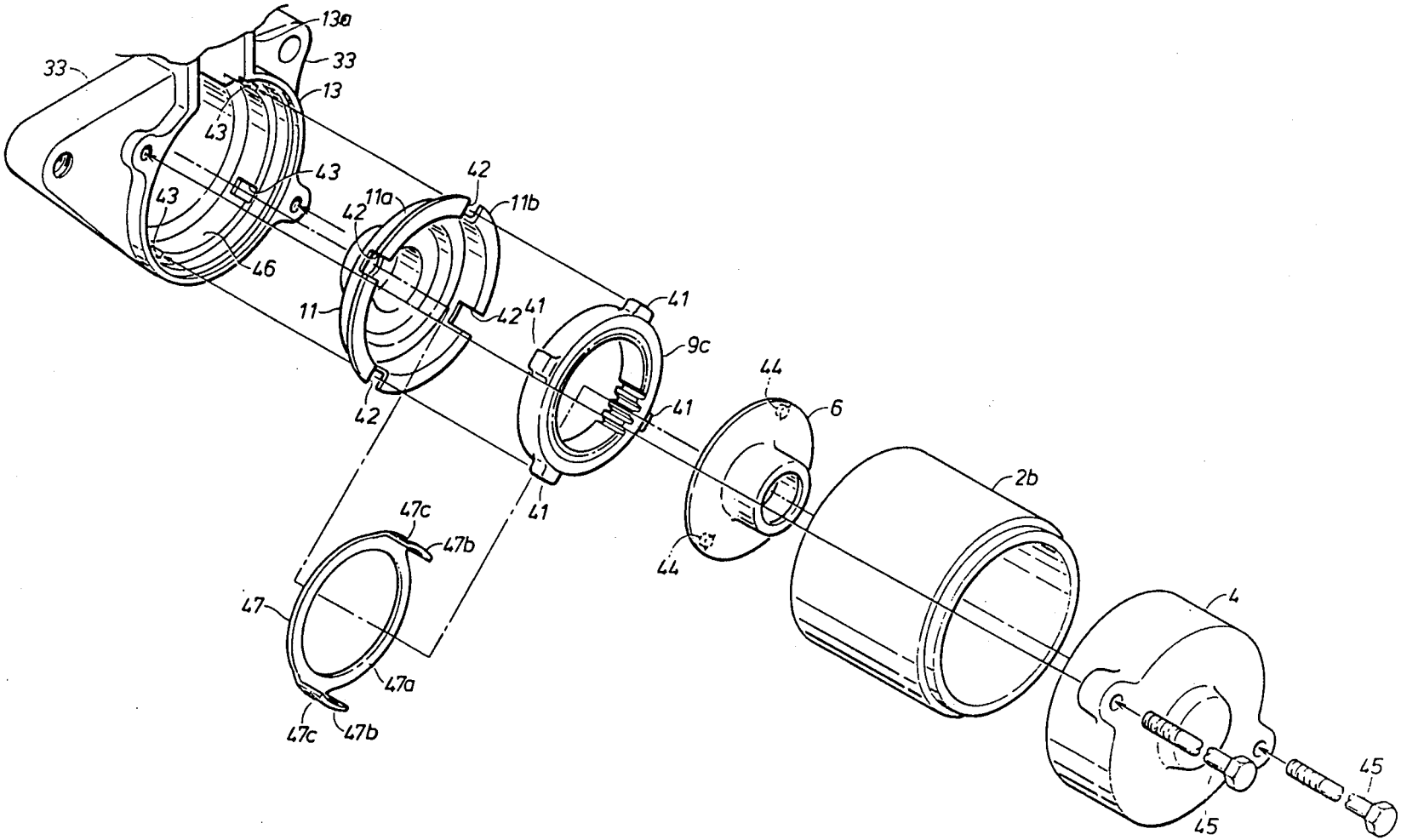
FIG. 2 is an exploded view of an essential part of the engine starter system according to the present invention.

A part of the pinion cover 13 of the thus constructed starter 1 adjacent its base end, on the right hand side of FIG. 1, is provided with a fitting boss portion 31 which has an outer circumferential surface coaxial with the drive shaft 16 and adapted to be fitted into a corresponding bore provided in a transmission case 32 of the engine, and a pair of radially and outwardly extending mounting flange portions 33 are provided in parts of the pinion cover 13 adjacent the base end portion of the fitting boss portion 31, for the convenience of mounting the starter 1 on the transmission case 32 of the engine (refer to FIG. 2). The starter 1 may be secured on the transmission case 32 by passing threaded bolts through bolt passing holes provided in free ends of the mounting flange portions 33.

As mentioned earlier, the internal gear 9c of the planetary reduction gear unit 9 is coaxially accommodated in the large diameter cylindrical portion 11a of the center bracket 11, and is, along with the center bracket 11, prevented from rotating relative to the pinion cover 13. This support structure is now described in the following with reference to FIG. 2.

As best illustrated in FIG. 2, the internal gear 9c is provided with four radially external engagement projections 41 at equal interval around its outer circumferential surface, and the center bracket 11 is provided with engagement notches 42 each extending over its large diameter cylindrical portion 11a and a flange portion 11b provided on its free end, the engagement notches 42 being associated with the engagement projections 41 when the internal gear 9c is fitted into the large diameter cylindrical portion 11a. The engagement projections 41 are so designed to project radially and outwardly from the outer circumferential surface of the large diameter cylindrical portion 11a through the engagement notches 42 when the internal gear 9c is fitted into the center bracket 11.

A seal member 47, consisting of an annular base portion 47a and a pair of projecting pieces 47b provided around the outer circumferential portion thereof at diagonally opposed positions, is interposed between an axial end surface of the internal gear 9c and an axial inner end surface of the large diameter cylindrical portion 11*a* of the center bracket 11 at its base portion 47*a*. Therefore, any longitudinal dimensional error between the large diameter cylindrical portion 11*a* of the center bracket 11 and the separator 6 is accommodated thereby, and any leakage of the grease applied around the inner circumferential portion of the internal gear 9*c* is avoided. The projecting pieces 47*b* are each provided with an engagement hole 47*c* for receiving an associated one of the engagement projections 41 provided at the diagonally opposed positions of the internal gear 9*c* so that the engagement projections 41 may abut the inner circumferential edges of the engagement notches 42 via the projecting pieces 47*b* of the seal member 47 by mounting the seal member 47 on the internal gear 9*c* with the projecting pieces 47*b* passed through engagement hole 47*c*, and fitting the engagement projections 41 into the associated engagement notches 42 of the center bracket 11, and the two members may be elastically prevented from rotating relative to each other.

The open axial end of the pinion cover 13 is increased in diameter in a step-wise fashion from its inner end toward its open end, and a part thereof defines an opening 46 for receiving the large diameter cylindrical portion 11*a* of the center bracket 11. The opening 46 is provided with engagement recesses 43 corresponding to the engagement projections 41 of the internal gear 9*c* when the center bracket 11 is mounted along with the internal gear 9*c* on the pinion cover 13. The engagement recesses 43 are defined in an annular shoulder defined in the open axial end of the pinion cover 13 which is increased in diameter in a step-wise fashion from its inner end toward its open end Therefore, when the center bracket 11 is mounted, along with the internal gear 9*c*, on the pinion cover 13, the free ends of the engagement projections 41 engage with the engagement recesses 43 so as to prevent both the internal gear 9*c* and the center bracket 11 from rotating relative to the pinion cover 13. In this way, there is no need to provide two separate engagement structures on the center bracket 11 for both the internal gear 9*c* and the pinion cover 13, and the overall structure can be simplified because the center bracket 11 is only required to be provided with the engagement notches 42 corresponding to the engagement projections 41.

To the end of preventing the rotation of the separator 6, as shown in FIG. 2, there are provided on an end surface of the separator 6 facing the planetary reduction gear unit 9 a pair of cylindrical projections 44 in diagonally opposed positions so as to correspond to two of the engagement notches 42 of the center bracket 11. By placing the projections 44 into the engagement notches 42 with the separator 6 placed over the center bracket 11, the separator 6 can be favorably prevented from rotating with a simple structure because the projections 44 engage with the side edges of the engagement notches 42 even when the rotational force of the motor 2 tends to rotate the separator 6.

Further, according to this starter 1, the separator 6 and the center bracket 11 are interposed between the end surfaces of the pinion cover 13 and the motor casing 2*b*, and the thrust force produced by set bolts 45 which join the motor casing 2*b* and the pinion cover 13 together is received by the entire circumference of the separator 6 and the center bracket 11. Therefore, the center bracket 11 receives the thrust force by the entire circumference thereof by way of the separator 6, and the support rigidity of the planetary reduction gear unit 9 is increased so as to improve its durability and capability to withstand impacts.

Although the engagement projections were provided on the internal gear 9*c* while the engagement recesses were provided in the pinion cover 13 serving as a casing, it is possible, according to the present invention, to provided the engagement projections and the engagement recesses on the other parts of the starter.

Thus, according to the present invention, the center bracket for the internal gear of the planetary reduction gear unit, along with the internal gear, is prevented from rotating relative to the casing by using engagement projections provided in either the internal gear or the casing, and it suffices if the center bracket is only provided with engagement notches which can engage with the engagement projections so that the support structure for the planetary reduction gear unit for an engine starter system can be simplified.

Although the present invention has been described in terms of a preferred embodiment thereof, it is obvious to a person skilled in the art that various alterations and modifications are possible without departing from the scope of the present invention which is set forth in the appended claims.

What we claim is:

1. A starter system for an internal combustion engine, comprising:

an electric motor accommodated in a motor casing;

a center bracket coaxially attached to an end portion of said motor casing defining a cylindrical chamber for accommodating a planetary reduction gear unit therein between said center bracket and an end plate of said motor casing; and a pinion cover secured to a same longitudinal end of said electric motor as said center bracket defining a chamber for accommodating an overrunning clutch having an input member connected to an output end of said planetary reduction gear unit and an output member carrying a pinion thereon;

one of an internal gear of said planetary reduction gear unit and said pinion cover being provided with a projection which passes through an opening provided in said center bracket and engages with a recess provided in the other of said internal gear of said planetary reduction gear unit and said pinion cover.

2. A starter system for an internal combustion engine according to claim 1, wherein said projection consists of a radial projection extending radially from an outer circumferential surface of said internal gear, and said recess consists of a recess provided in an annular shoulder defined in an inner circumferential surface of an open end of said pinion cover facing said center bracket.

3. A starter system for an internal combustion engine according to claim 2, wherein said center bracket is provided with a cylindrical portion adapted to receive an outer circumferential surface of said internal gear, and a radial flange extending outwardly from a longitudinal end of said cylindrical portion facing said electric motor, said opening being defined over an outer wall of said cylindrical portion and said radial flange of said center bracket.

4. A starter system for an internal combustion engine according to claim 3, wherein said end plate of said motor casing is provided with a longitudinal projection which is adapted to be fitted into said opening provided in said center bracket.

5. A starter system for an internal combustion engine according to claim 4, further comprising an annular seal member interposed between a shoulder surface of said center bracket adjoining a base end of said cylindrical portion and a longitudinal end surface of said internal gear, said seal member being provided with a radial projection which is adapted to be received by said opening of said center bracket and provided with an opening for receiving said projection of said internal gear.

6. A starter system for an internal combustion engine according to claim 4, wherein said motor casing, said internal gear, said center bracket, and said pinion cover are joined together by at least a pair of threaded bolts passed through said motor case and said pinion cover.

* * * * *